US008100400B2

(12) United States Patent
Seki

(10) Patent No.: US 8,100,400 B2
(45) Date of Patent: Jan. 24, 2012

(54) SHEET EJECTING DEVICE WITH SHEET STRENGTHENER

(75) Inventor: Shinobu Seki, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 309 days.

(21) Appl. No.: 12/370,776

(22) Filed: Feb. 13, 2009

(65) Prior Publication Data

US 2009/0206546 A1 Aug. 20, 2009

(30) Foreign Application Priority Data

Feb. 14, 2008 (JP) ..... 2008-033681

(51) Int. Cl.
*B65H 29/70* (2006.01)

(52) U.S. Cl. ..... 271/188; 271/176

(58) Field of Classification Search ..... 271/188, 271/176

See application file for complete search history.

(56) References Cited

U.S. PATENT DOCUMENTS

| | | | | |
|---|---|---|---|---|
| 5,110,104 | A * | 5/1992 | Wakao et al. | 271/3.03 |
| 7,434,802 | B2 * | 10/2008 | Yamamoto | 271/188 |

FOREIGN PATENT DOCUMENTS

| | | | |
|---|---|---|---|
| JP | 58-38641 | | 9/1956 |
| JP | 09-227007 | | 9/1997 |
| JP | 2002-167102 | | 6/2002 |
| JP | 2002167102 | A * | 6/2002 |
| JP | 2002-274734 | | 9/2002 |
| JP | 2005-263418 | A | 9/2005 |
| JP | 2006-062855 | | 3/2006 |
| JP | 2006062855 | A * | 3/2006 |
| JP | 2006-103869 | | 4/2006 |
| JP | 2007-176689 | | 7/2007 |
| JP | 2008-019080 | | 1/2008 |
| JP | 2008-156012 | | 7/2008 |

OTHER PUBLICATIONS

Notification of Reasons for Refusal issued in the corresponding Japanese Patent Application No. 2008-033681 dated Mar. 2, 2010, and an English Translation thereof.

* cited by examiner

*Primary Examiner* — Gerald McClain
(74) *Attorney, Agent, or Firm* — Buchanan Ingersoll & Rooney PC

(57) ABSTRACT

A sheet ejecting device has a pair of ejection rollers, a strengthener arranged in the sheet ejection device, for strengthening a sheet, a driver for moving the strengthener to advance into and retreat from a sheet ejection route, a sheet sensor, and a tray for receiving sheets ejected via the pair of ejection rollers and holding the sheets in a stack. Based on a detection signal from the sheet sensor, the strengthener is moved to advance into and retreat from the sheet ejection route so that only a necessary part of a sheet can be strengthened.

10 Claims, 11 Drawing Sheets

SHEET EJECTING DEVICE WITH SHEET STRENGTHENER

This application is based on Japanese application No. 2008-033681 filed on Feb. 14, 2008, of which content is incorporated herein by reference.

BACKGROUND OF THE INVENTION

1. Field of the Invention

The present invention relates to a sheet ejecting device, and more particularly to a sheet ejecting device that is suited to be employed in an image forming apparatus such as an electrophotographic copying machine or a printer, or in an after-processing device such as a finisher connected to the image forming apparatus.

2. Description of Related Art

When a printed sheet is ejected from an image forming apparatus onto a sheet tray through a pair of ejection rollers, if the sheet is soft, trouble will occur. Specifically, the leading part of the soft sheet bends downward, and the sheet interferes with sheets already ejected and stacked on the tray. Thereby, the sheets stacked on the tray will be out of alignment.

In order to avoid this trouble, as disclosed by JP58-38641A and JP2005-263418A, conventionally, a currently ejected sheet is curved in a direction perpendicular to the sheet ejecting direction by use of a spring, an elastic member, a roller or the like so that the leading edge of the currently ejected sheet will be in contact with a stack of sheets on the tray at a point farther from the pair of ejection rollers. Thereby, the leading part of the currently ejected sheet is prevented from interfering with the stack of sheets on the tray and from pushing the stack of sheets on the tray out of alignment. However, since the currently ejected sheet is curved and strengthened evenly from the leading edge to the trailing edge, the sheet may jump out of the pair of ejection rollers with great force, and consequently, the sheet may push the stack of sheets on the tray out of alignment.

FIG. 17*a* shows a case of ejecting a sheet S onto a sheet tray 110 via a pair of ejection rollers 101 while not strengthening the sheet S. If the sheet S is very soft, the leading part of the sheet S bends downward after coming out of the ejection rollers 101 and interferes with a stack of sheets S' at a position near the ejection rollers 101, and the stack of sheets S' is pushed.

As FIG. 17*b* shows, when the sheet S is strengthened and ejected, the leading edge of the sheet S comes into contact with the stack of sheets S' at a point farther from the ejection rollers 101, and the interference between the sheet S and the stack of sheets S' is eased. Thereby, the sheet S is ejected onto the sheet tray 110 in alignment with the stack of sheets S'. FIG. 17*c* shows a case of ejecting a sheet S1 of a relatively large size while strengthening the sheet S1 from the leading edge to the trailing edge evenly. In this case, before the trailing edge of the sheet S1 comes out of the ejection rollers 101, the strengthened sheet S1 becomes soft again, and it does not occur that the sheet S1 is tense between the ejection rollers 101 and the stack of sheets S'. Thereby, the sheet S1 is ejected onto the stack of sheets S' smoothly, and there is no possibility that the sheet S1 and the stack of sheets S' on the sheet tray 110 will be out of alignment.

FIG. 17*d* shows a case of ejecting a sheet S2 of a relatively small size while strengthening the sheet S2. In this case, the leading edge of the strengthened sheet S2 comes into contact with the stack of sheets S', and while the sheet S2 keeps strong, the trailing edge of the sheet S2 comes out of the ejection rollers 101. Therefore, the sheet S2 is tense between the ejection rollers 101 and the stack of sheets S', and the sheet S2 comes out of the ejection rollers 101 with great force. Thereby, the sheet S2 cannot be in alignment with the stack of sheets S'.

SUMMARY OF THE INVENTION

An object of the present invention is to provide a sheet ejecting device for ejecting a sheet onto a tray while strengthening the sheet so that the sheet can be ejected in alignment with a stack of sheets on the tray without pushing the stack of sheets out of alignment.

In order to achieve the object, according to a first aspect of the present invention, a sheet ejecting device for ejecting printed sheets one by one comprises: a pair of ejection rollers for ejecting a sheet; a strengthener, arranged to be capable of advancing into and retreating from a sheet ejection route, for strengthening a sheet; a driver for moving the strengthener to advance into and retreat from the sheet ejection route; a sensor for detecting a currently ejected sheet; and a controller for controlling the driver based on a signal sent from the sensor so that the strengthener can operate to strengthen a predetermined part of a sheet.

In the sheet ejecting device, the strengthener is moved to advance into and retreat from the sheet ejection route so that only a necessary part of a sheet can be strengthened. Therefore, there is no possibility that the leading part of a currently ejected sheet may bend downward and push a stack of sheets on the tray out of alignment. Further, even if the currently ejected sheet is of a small size, there is no possibility that the sheet may jump out of the ejection rollers with great force, and the sheet can be ejected onto the tray in alignment with the stack of sheets.

According to a second aspect of the present invention, a sheet ejecting device for ejecting printed sheets one by one comprises: a pair of ejection rollers; a strengthener, located in a sheet ejection route, for providing a force for a sheet; a bender, arranged to be capable of advancing into and retreating from the sheet ejection route, for canceling out the force provided for the sheet by the strengthener; a driver for moving the bender to advance into and retreat from the sheet ejection route; a sensor for detecting a currently ejected sheet; and a controller for controlling the driver based on a signal sent from the sensor so that the bender can cancel out the force provided for the sheet by the strengthener.

In the sheet ejecting device, the currently ejected sheet is provided with a force by the strengthener, and there is no possibility that the leading part of the sheet may downward and push a stack of sheets on the tray out of alignment. Further, the bender is driven at a good time to cancel out the force provided for the sheet by the strengthener. Thereby, even if the sheet is of a small size, there is no possibility that the sheet may jump out of the ejection rollers with great force, and the sheet can be ejected onto the tray in alignment with the stack of sheets.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Sheet ejecting devices according to preferred embodiments of the present invention are hereinafter described with reference to the drawings. In the following embodiments, the same members and parts are provided with the same reference symbols, and repetitious descriptions are omitted.

First Embodiment

Figure 1:
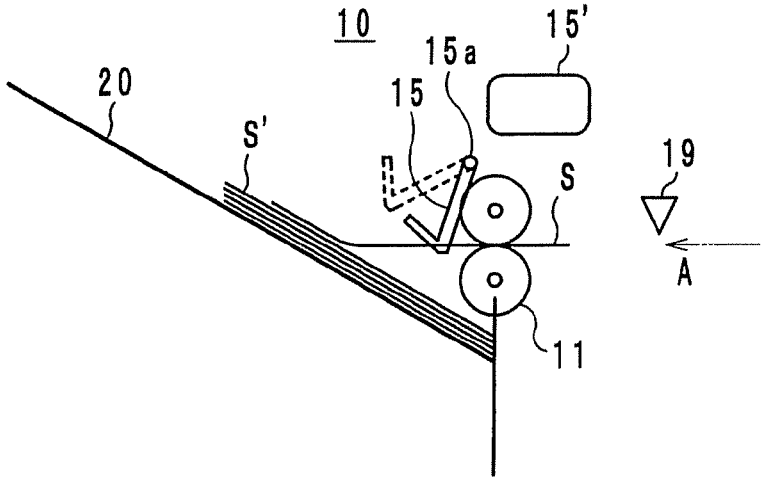
FIG. 1 is a schematic elevation view of a sheet ejecting device according to a first embodiment of the present invention.
Figure 2:
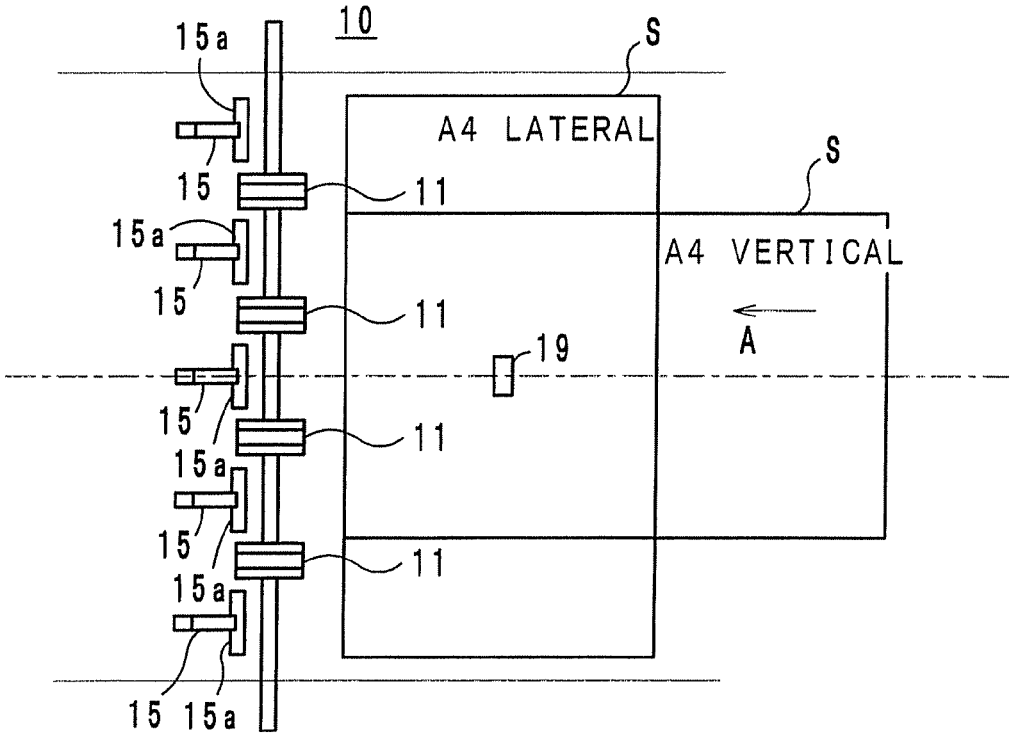
FIG. 2 is a schematic plan view of the sheet ejecting device according to the first embodiment.

See FIGS. 1 and 2

As FIGS. 1 and 2 show, a sheet ejecting device according to a first embodiment is used as a sheet ejecting section 10 of an image forming apparatus, such as a copying machine and a printer, or of an after-processing device, such as a finisher, connected to the image forming apparatus. The sheet ejecting device generally comprises a pair of ejection rollers 11 for ejecting a sheet S, a strengthener 15, arranged to advance into and retreat from a sheet ejection route, for strengthening a sheet S, a sheet sensor 19 located in the sheet ejection route, and a tray 20 for receiving sheets S ejected via the pair of ejection rollers 11 and holding the sheets S in a stack.

The strengthener 15 comprises a plurality of levers (five levers, in the first embodiment), and the plural levers are aligned in a position immediately downstream from the ejection rollers 11, in a direction perpendicular to a sheet ejecting direction "A". Each of the levers 15 is pivoted on a pin 15*a*, and a driver section 15', which is composed of a motor, a solenoid, etc., drives the levers 15 to move between a position shown by the solid line in FIG. 1 (an advance position) and a position shown by the dashed line in FIG. 1 (a retreat position).

A printed sheet S is fed from the direction indicated by an arrow "A" into a nip portion of the ejection rollers 11 and is ejected onto the tray 20 by the rotation of the ejection rollers 11. In this moment, the strengthening levers 15 advance into the sheet ejection route to curve the sheet S in a direction perpendicular to the ejecting direction "A" such that the curvature extends in the ejecting direction "A", and the curved and strengthened sheet S is ejected onto the tray 20.

More specifically, first, the leading edge of the sheet S is detected by the sensor 19. Then, before the leading edge of the sheet S reaches the strengthener 15, the levers 15 advance into the sheet ejection route. Thereby, the strengthening of the sheet S starts with the leading edge of the sheet S. The strengthened sheet S comes into contact with a stack of sheets S' on the tray 20 at a point farther from the ejection rollers 11 than a point at which a non-strengthened sheet comes into contact with the stack of sheets S' on the tray 20. Therefore, there is no possibility that the sheet S will push the stack of sheets S' out of alignment.

When (or a specified time after) the trailing edge of the sheet S is detected by the sensor 19 or a specified time after the leading edge of the sheet S is detected by the sensor 19, the strengthening levers 15 retreat upward from the sheet ejection route and stop strengthening the sheet S. In other words, at a time after the leading edge of the sheet S comes into contact with the stack of sheets S' and before the sheet S passes through the nip portion of the ejection rollers 11, the levers 15 retreat from the sheet ejection route. Thereafter, the sheet S is not strengthened. Thus, when the sheet S passes through the ejection rollers 11, the sheet S is no longer strengthened, and there is no possibility that the sheet S may jump out of the ejection rollers 11 with great force. Consequently, the sheet S can be ejected in alignment with the stack of sheets S' on the tray 20.

Second Embodiment

Figure 3:
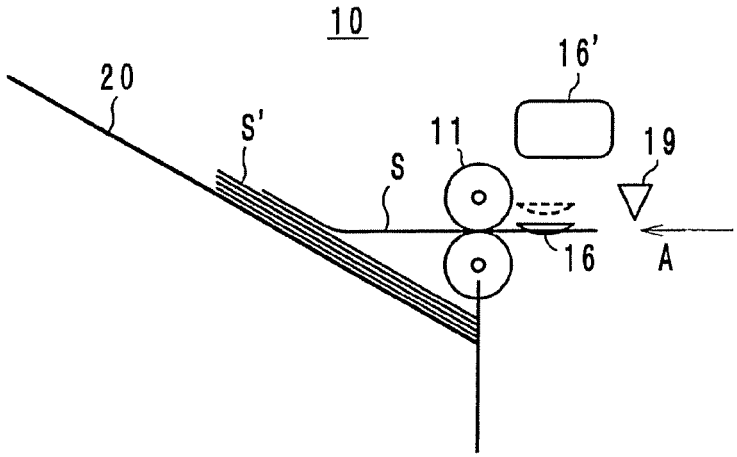
FIG. 3 is a schematic elevation view of a sheet ejecting device according to a second embodiment of the present invention.
Figure 4:
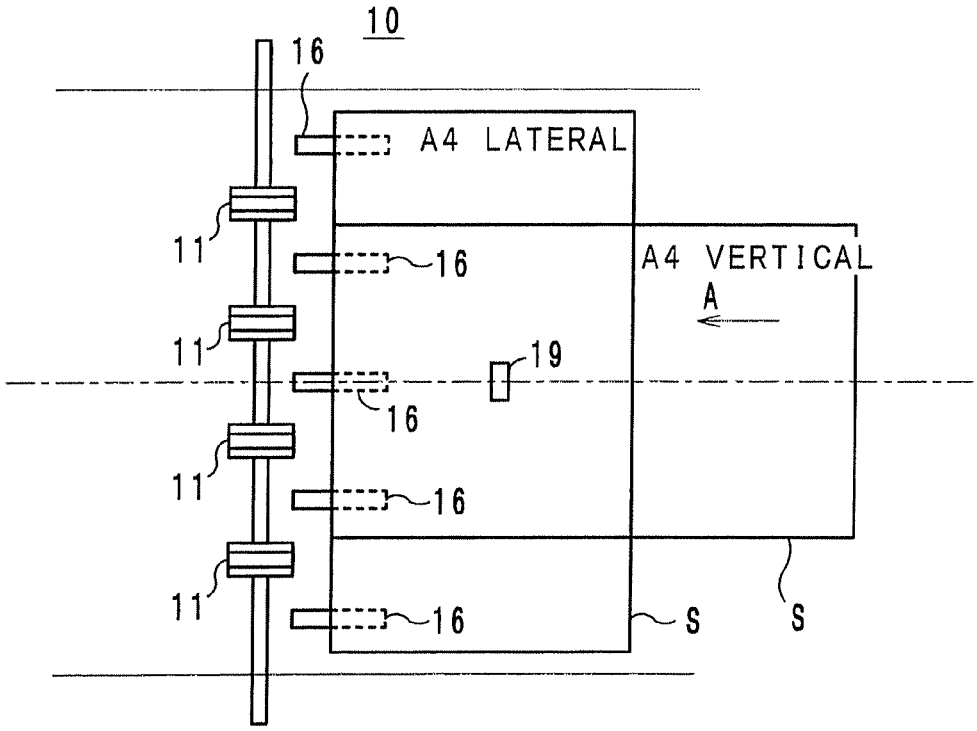
FIG. 4 is a schematic plan view of the sheet ejecting device according to the second embodiment.

See FIGS. 3 and 4

A second embodiment of the present invention, which is shown by FIGS. 3 and 4, basically has the same structure as the first embodiment. A sheet ejecting device according to the second embodiment has a strengthener 16 and a driver section 16' for driving the strengthener 16 to advance into and retreat from the sheet ejection route.

The strengthener 16 comprises a plurality of plates (five plates, in the second embodiment), and the plural plates are aligned in a position immediately upstream from the ejection rollers 11, in the direction perpendicular to the sheet ejecting direction "A". Each of the strengthening plates 16 is movable up and down, and the driver section 16', which is composed of a motor, solenoid, etc., moves the plates 16 between a position shown by the solid line in FIG. 3 (an advance position) and a position shown by the dashed line in FIG. 3 (a retreat position).

Like in the first embodiment, a printed sheet S is detected by the sensor 19, strengthened by the strengthener 16 and ejected onto the tray 20. The strengthened sheet S comes into contact with a stack of sheets S' on the tray 20 at a point farther from the ejection rollers 11 than a point at which a non-strengthened sheet comes into contact with the stack of sheets S' on the tray 20. Therefore, there is no possibility that the sheet S will push the stack of sheets S' out of alignment.

When (or a specified time after) the trailing edge of the sheet S is detected by the sensor 19 or a specified time after the leading edge of the sheet S is detected by the sensor 19, the strengthening plates 16 retreat upward from the sheet ejection route and stop strengthening the sheet S. In other words, at a time after the leading edge of the sheet S comes into contact with the stack of sheets S' and before the sheet S passes through the nip portion of the ejection rollers 11, the plates 16 retreat from the sheet ejection route. Thereafter, the sheet S is not strengthened. Thus, when the sheet S passes through the ejection rollers 11, the sheet S is no longer strengthened, and there is no possibility that the sheet S may jump out of the ejection rollers 11 with great force. Consequently, the sheet S can be ejected in alignment with the stack of sheets S' on the tray 20.

Strengthener

The strengthener comprises levers (in the first embodiment) or plates (in the second embodiment) made of metal, resin or an elastic material, and the levers or the plates are capable of advancing into and retreating from the sheet ejection route. As shown in FIGS. 2 and 4, the levers or the plates are arranged among wheels of the ejection rollers 11. The strengthener may have only one lever or one plate, and in this case, the single lever or plate is arranged in the center with respect to the direction perpendicular to the sheet ejecting direction "A".

When the strengthener comprises a plurality of levers 15 or a plurality of plates 16, the plural levers or plates may be selectively driven in accordance with the size of the sheet. For example, when an A4-sized sheet is ejected with its shorter sides parallel to the sheet ejecting direction (hereinafter referred to as A4-lateral sheet ejection), all the levers 15 or all the plates 16 are driven. On the other hand, when an A4-sized sheet is ejected with its longer sides parallel to the sheet ejecting direction (hereinafter referred to as A4-vertical sheet ejection), the sheet does not pass both sides of the sheet ejection route, and it is not necessary to drive the levers 15 or the plates 16 located on both sides of the sheet ejection route.

Further, the amount by which the levers 15 and the plates 16 advance into the sheet ejection route may be variable. The levers 15 or the plates 16 provide a sheet with a force in proportion to the advancing amount, and by varying the advancing amount of the levers 15 or the plates 16, it is possible to provide a sheet with a variable force.

Control Procedure

Figure 5:
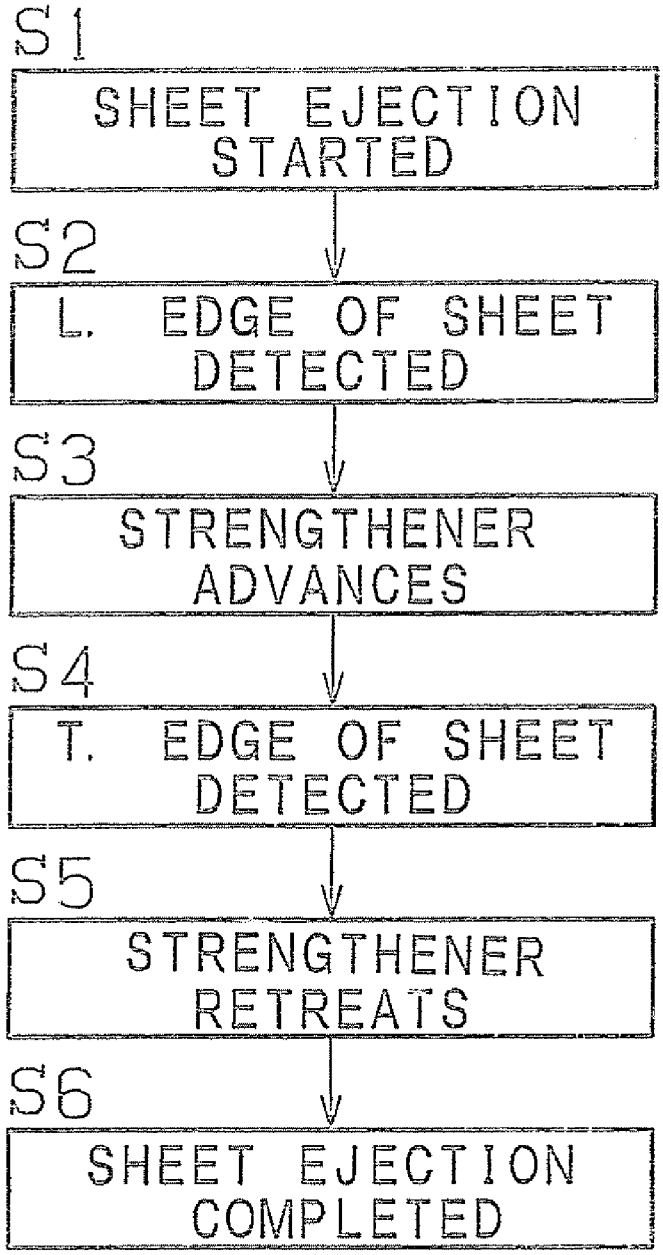
FIG. 5 is a flowchart showing a control procedure carried out in each of the sheet ejecting devices according to the first and the second embodiments.

See FIG. 5

Referring to FIG. 5, a control procedure for each of the sheet ejecting devices according to the first and the second embodiments is described. The control procedure is carried out by a CPU provided in the image forming apparatus or in the after-processing device. Ejection of a sheet S is started (step S1), and when the leading edge of the sheet S is detected by the sensor 19 (step S2), the strengthener 15 or 16 is moved to advance into the sheet ejection route (step S3). Thereby, the sheet S is strengthened. Thereafter, when the trailing edge of the sheet S is detected by the sensor 19 (step S4), the strengthener 15 or 16 retreats from the sheet ejection route and stops strengthening the sheet S (step S5). Then, ejection of one sheet S is completed (step S6).

Time to Operate the Strengthener

See FIGS. 6-9

Figure 6:
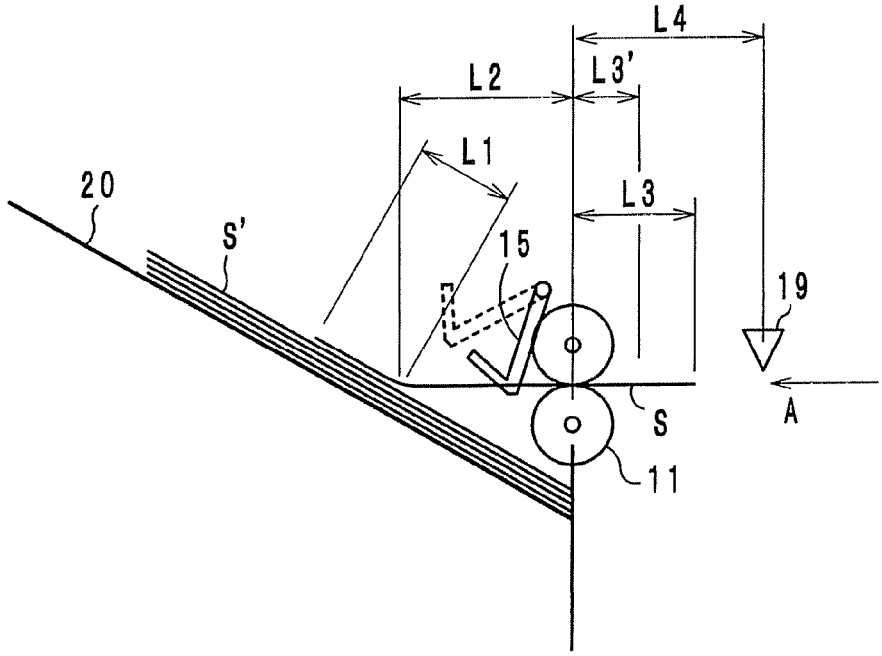
FIG. 6 is an illustration showing the relationship between a currently ejected sheet and the components of the sheet ejecting device according to the first embodiment.
Figure 7:
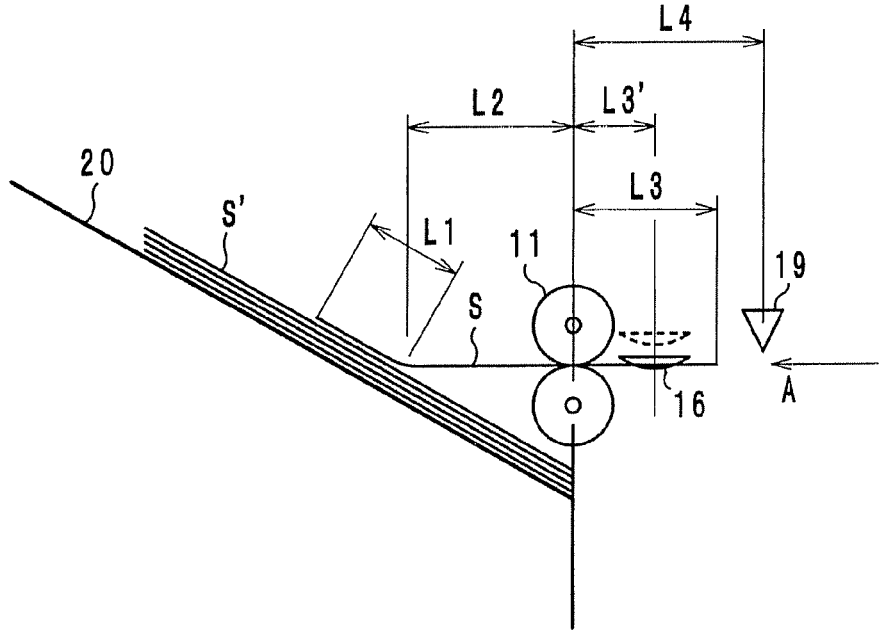
FIG. 7 is an illustration showing the relationship between a currently ejected sheet and the components of the sheet ejecting device according to the second embodiment.

FIG. 6 shows the relationship between the position of the sheet S and the time to operate the strengthener 15 in the first embodiment. FIG. 7 shows the relationship between the position of the sheet S and the time to operate the strengthener 16 in the second, embodiment. The reference symbol "L1" denotes a predetermined distance (approximately 50 mm) by which the sheet S is further conveyed after the leading edge of the sheet S comes into contact with the stack of sheets S' on the tray 20. The reference symbol "L2" denotes a distance (approximately 100 mm) between the nip portion of the ejection rollers 11 and a contact point of the sheet S with the stack of sheets S'. The reference symbol "L3" denotes a distance between the nip portion of the ejection rollers 11 and the trailing edge of the sheet S. The reference symbol "L4" denotes a distance between the nip portion of the ejection rollers 11 and the sensor 19. The reference symbol "L3'" denotes a distance calculated by subtracting 30 mm from the distance L3. The distance L3 should be at least 30 mm, and the strengthener 15 or 16 retreats from the sheet S at a time while the part L3' of the sheet S passes through the nip portion of the ejection rollers 11.

Figure 8:
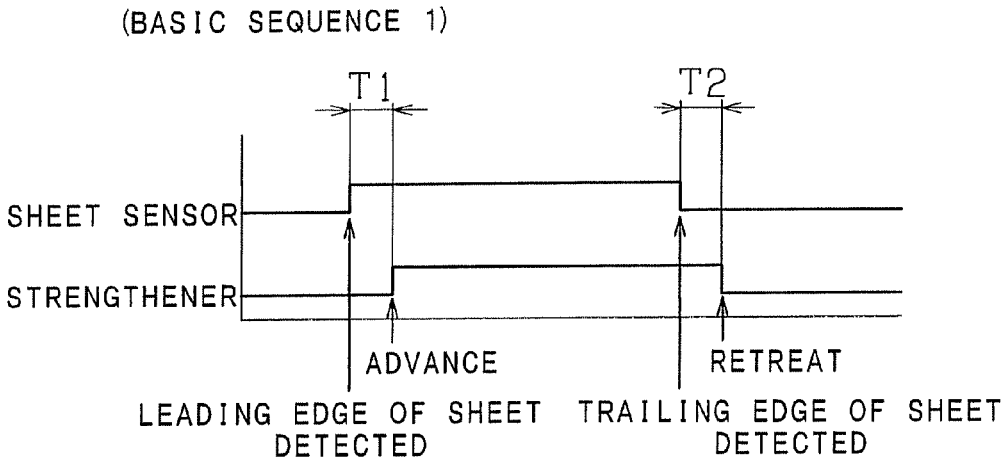
FIG. 8 is a time chart showing a first basic sequence for operating a strengthener in each of the sheet ejecting devices according to the first and the second embodiments.
Figure 9:
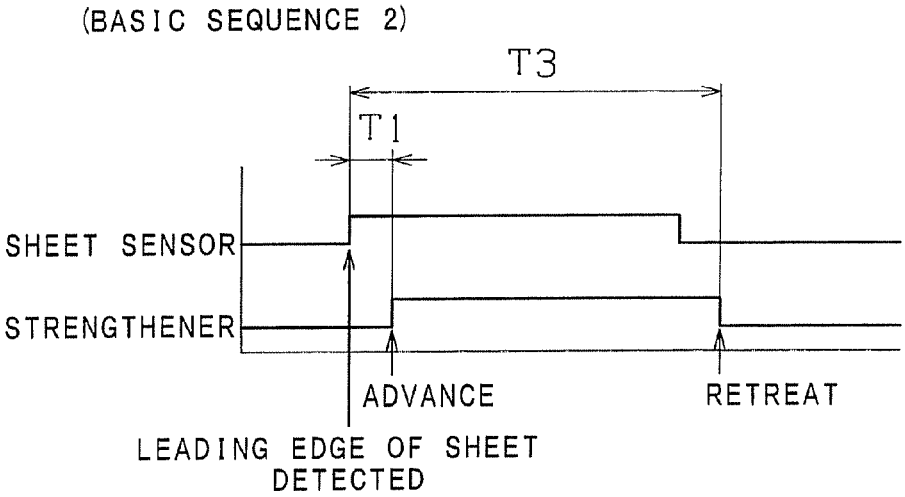
FIG. 9 is a time chart showing a second basic sequence for operating the strengthener in each of the sheet ejecting devices according to the first and the second embodiments.

FIG. 8 shows a first basic sequence for moving the strengthener 15 or 16, and FIG. 9 shows a second basic sequence for moving the strengthener 15 or 16. In the first basic sequence shown by FIG. 8, a time T1 after the leading edge of the sheet S is detected by the sensor 19, the strengthener 15 or 16 is moved to advance into the sheet ejection route. Thereafter, a time T2 after the trailing edge of the sheet S is detected by the sensor 19, the strengthener 15 or 16 is moved to retreat from the sheet ejection route. Thus, in the first basic sequence, the time to move the strengthener to advance into the sheet ejection route and the time to move the strengthener to retreat from the sheet ejection route are based on a detection signal of the leading edge of the sheet S and a detection signal of the trailing edge of the sheet S, respectively.

In the second basic sequence shown by FIG. 9, the time T1 after the leading edge of the sheet S is detected by the sensor 19, the strengthener 15 or 16 is moved to advance into the sheet ejection route, and a time T3 after the leading edge of the sheet S is detected by the sensor 19, the strengthener 15 or 16 is moved to retreat from the sheet ejection route. The time to move the strengthener to retreat from the sheet ejection route, that is, the time T3 varies depending on the size of the sheet S.

Setting of Strengthener Retreating Time

In the first and the second embodiments, for example, the time T3 to move the strengthener 15 or 16 to retreat from the sheet ejection route in the second basic sequence may be changed in accordance with the size of the sheet S (the dimension of the sheet S in the sheet ejecting direction "A"), the kind of the sheet S, the environmental conditions, etc. Referring to FIGS. 6 and 7, the distance of travel of the sheet S between the time when the sensor 19 detects the leading edge of the sheet S and the time when the strengthener 15 or 16 is moved to retreat from the sheet ejection route shall be within a range from (L4+L2+L1) to (the length of the sheet S+L4−L3).

If the distance L4 is 60 mm and if the speed of conveying the sheet S is 300 mm/s, the time T3 shall be within a range as shown by Table 1 below. In table 1, "A4-vertical" means the case of ejecting an A4-sized sheet with its longer sides parallel to the sheet ejecting direction, and "A4-lateral" means the case of ejecting an A4-sized sheet with its shorter sides parallel to the sheet ejecting direction.

TABLE 1

| | T3 |
|---|---|
| A4-Vertical | 0.7 sec.-1.09 sec. |
| A4-Lateral | 0.7 sec.-0.8 sec. |

When the sheet S is ejected via the ejection rollers 11, the sheet S bends downward by its own weight. The degree of the bend-down (the strength) of the sheet S depends on the kind of the sheet S (the weight per square meter, that is, whether to be thin paper, ordinary paper or thick paper, and whether to be recycled paper) and the environmental conditions (temperature and humidity). Therefore, it is preferred that the time T3 is determined based on the kind of the sheet S and the environmental conditions.

Table 2 below shows an exemplary setting of the time T3 in accordance with whether the sheet S is thin paper, ordinary paper or thick paper. Here, thin paper is paper with a weight per square meter smaller than 60 g/m$^2$. Ordinary paper is paper with a weight per square meter within a range from 60 g/m$^2$ to 90 g/m$^2$. Thick paper is paper with a weight per square meter greater than 90 g/m$^2$.

TABLE 2

| | A4-Vertical | A4-Lateral |
|---|---|---|
| Thin Paper | 1.0 sec. | 0.8 sec. |
| Ordinary Paper | 0.9 sec. | 0.75 sec. |
| Thick Paper | 0.8 sec. | 0.7 sec. |

Further, recycled paper is relatively soft, and the time T3 in the case of ejecting a sheet of recycled paper may be set longer than the time T3 in the case of ejecting a sheet of non-recycled paper with the same weight per square meter. Table 3 shows an exemplary setting of the time T3 in accordance with whether the sheet S is recycled paper.

TABLE 3

| | A4-Vertical | A4-Lateral |
|---|---|---|
| Recycled Paper | 1.0 sec. | 0.8 sec. |
| Non-recycled Paper | 0.9 sec. | 0.75 sec. |

Furthermore, it is preferred that the time T3 is set longer as the temperature and the humidity become higher. Table 4 shows an exemplary setting of the time T3 in accordance with whether the sheet ejecting device is under high temperature and high humidity, under ordinary temperature and ordinary humidity, or low temperature and low humidity.

TABLE 4

| | A4-Vertical | A4-Lateral |
|---|---|---|
| High-Temp/High-Humid | 1.0 sec. | 0.8 sec. |
| Ordinary-Temp/Ordinary Humid | 0.9 sec. | 0.75 sec. |
| Low-Temp/Low-Humid | 0.8 sec. | 0.7 sec. |

Control Procedure

Figure 10:
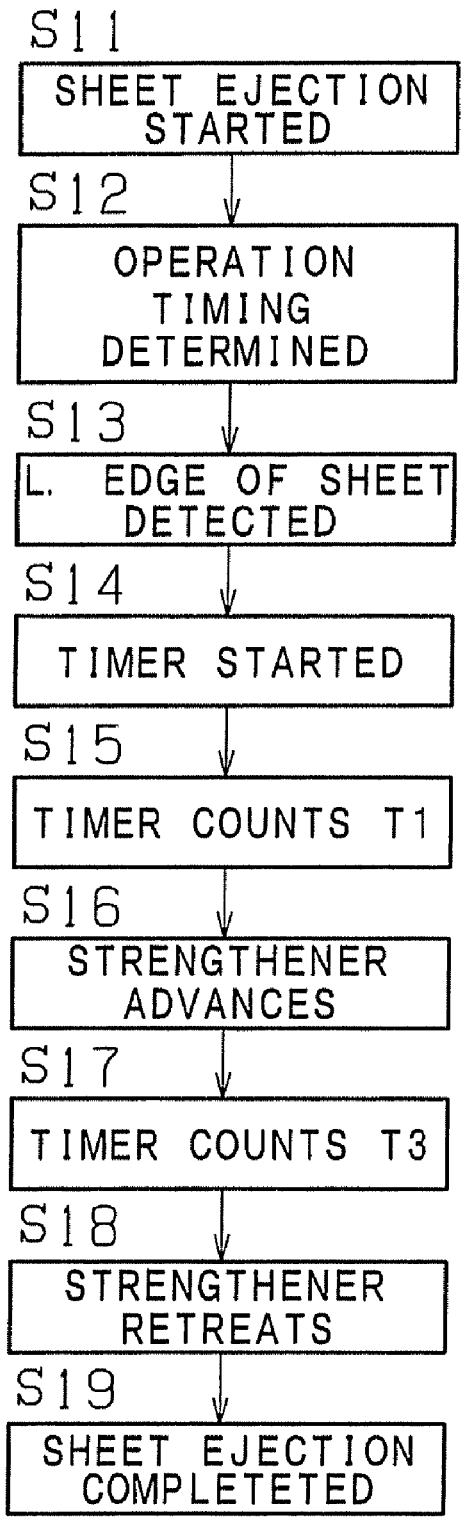
FIG. 10 is a flowchart showing another control procedure that may be carried out in each of the sheet ejecting devices according to the first and the second embodiments.

See FIG. 10

Referring to FIG. 10, in each of the sheet ejecting devices according to the first and second embodiments, a procedure for changing the time T3 in the second basic sequence in accordance with the conditions is described. Ejection of a sheet S is started (step S11), and the times to move the strengthener 15 or 16 (the times T1 and T3) are determined based on the size and the kind of the sheet S and the environmental conditions (step S12). When the leading edge of the sheet S is detected by the sensor 19 (step S13), a timer is started (step S14). When the timer counts the time T1 (step S15), the strengthener 15 or 16 is moved to advance into the sheet ejection route to strengthen the sheet S (step S16). The timer counts the time T3 (step S17), the strengthener 15 or 16 is moved to retreat from the sheet ejection route (step S18) to stop strengthening the sheet S. Then, ejection of one sheet S is completed (step S19).

Third Embodiment

Figure 11:
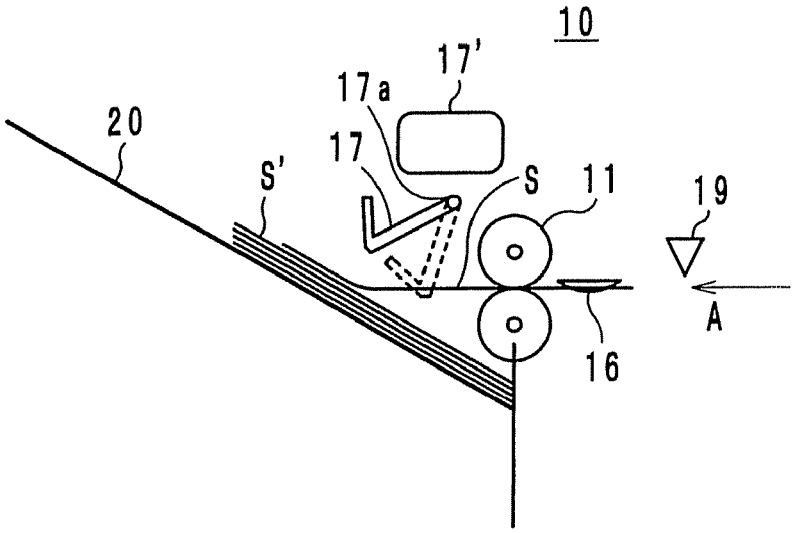
FIG. 11 is a schematic elevation view of a sheet ejecting device according to a third embodiment of the present invention.
Figure 12:
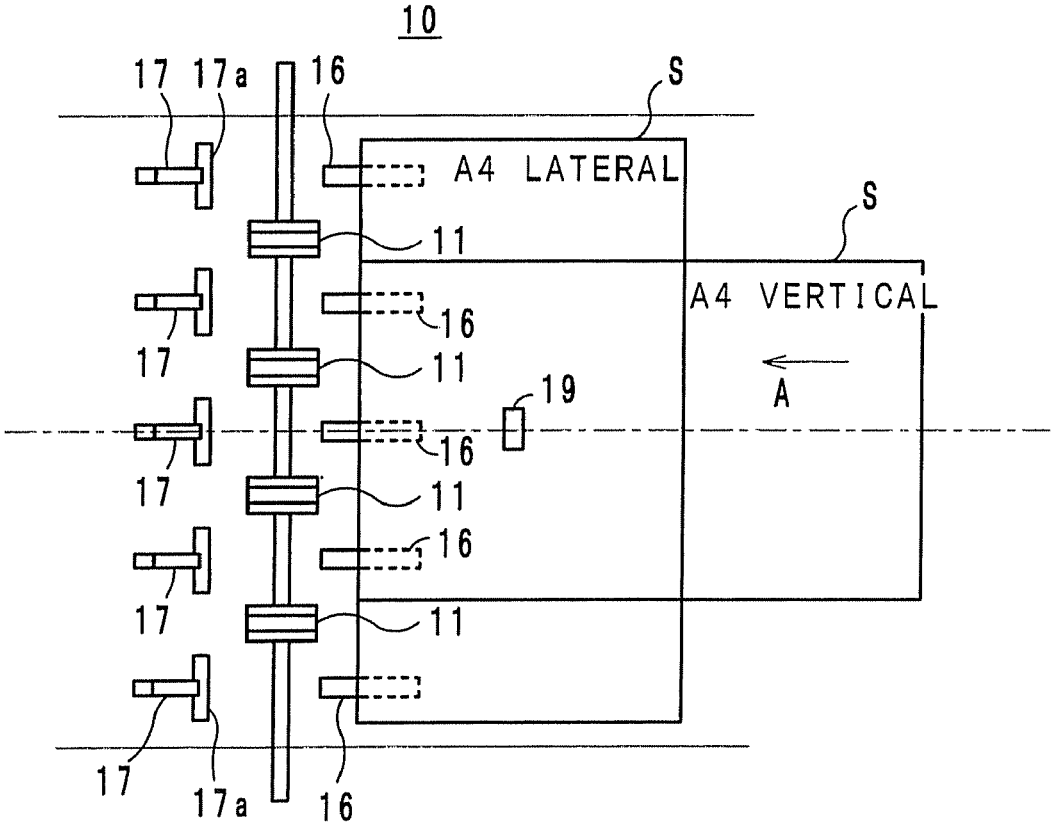
FIG. 12 is a schematic plan view of the sheet ejecting device according to the third embodiment.

See FIGS. 11 and 12

As FIGS. 11 and 12 show, a sheet ejecting device according to a third embodiment comprises a bender 17 in a position downstream from the ejection rollers 11 as well as the strengthener 16 located in a position upstream from the ejection rollers 11. The strengthener 16 comprises a plurality of components located fixedly in the sheet ejection route. The bender 17 comprises a plurality of levers (five levers, in the third embodiment) aligned in a direction perpendicular to the sheet ejecting direction "A". Each of the levers 17 is pivoted on a pin 17*a*, and the levers 17 are driven by a driver 17' (a motor, a solenoid, etc.) to pivot between a retreat position shown by the solid line and an advance position shown by the dashed line. When the bender 17 advances into the sheet ejection route at the position downstream from the ejection rollers 11 and pushes the strengthened sheet S, the force provided for the sheet S by the strengthener 16 is cancelled out.

In the third embodiment, the strengthener 16 that is fixed in the sheet ejection route curves the sheet S in the direction perpendicular to the sheet ejecting direction "A" with the curvature extending in the sheet ejecting direction "A", such that the sheet S is strengthened from the leading edge to the trailing edge. The strengthened sheet S comes into contact with a stack of sheets S' on the tray 20 at a point farther from the ejection rollers 11 than a point at which a non-strengthened sheet comes into contact with the stack of sheets S' on the tray 20. Therefore, there is no possibility that the sheet S will push the stack of sheets S' out of alignment.

At a time after the leading edge of the sheet S comes into contact with the stack of sheets S' and before the trailing edge of the sheet S passes through the ejection rollers 11, the bender 17 is driven to advance into the sheet ejection route so as to cancel out the force provided for the sheet S by the strengthener 16. Therefore, when the sheet S passes through the ejection rollers 11, the sheet S is no longer strengthened, and there is no possibility that the sheet S may jump out of the ejection rollers 11 with great force. Consequently, the sheets S' can be kept in alignment on the tray 20.

In the third embodiment, as the bender 17, a plurality of levers are aligned in the direction perpendicular to the sheet ejecting direction "A", and the levers are selectively driven in accordance with the size of the sheet S. However, the bender 17 may have only one lever located in the center with respect to the direction perpendicular to the sheet ejecting direction "A".

Time to Operate the Bender

Figure 13:
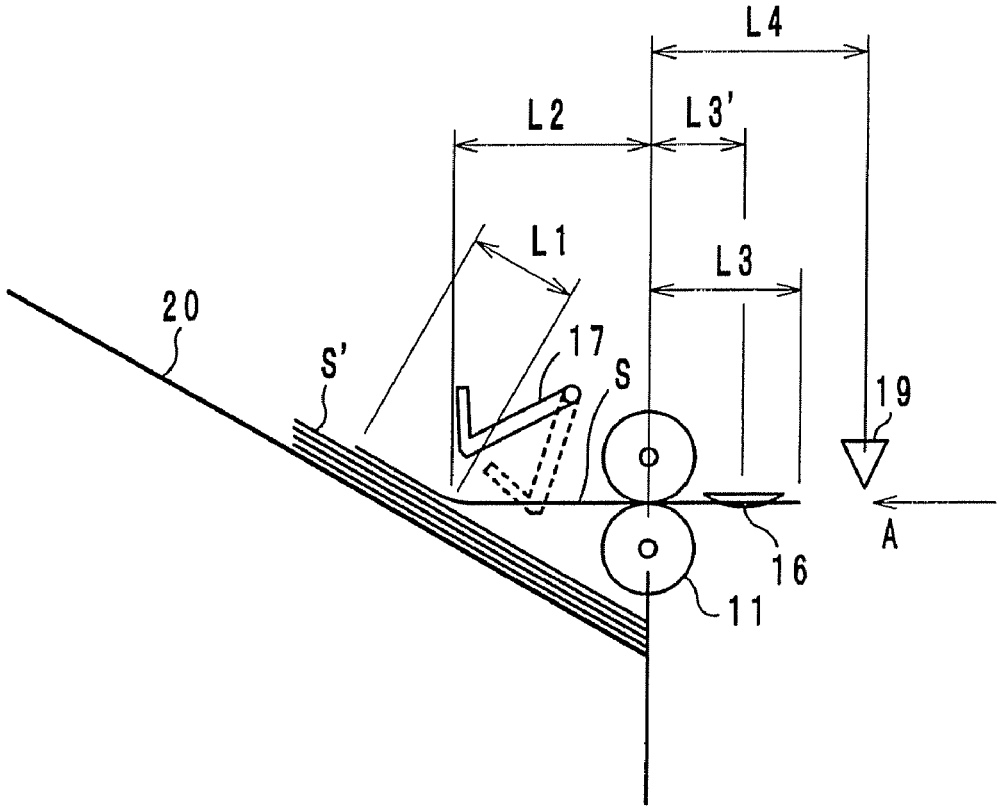
FIG. 13 is an illustration showing the relationship between a currently ejected sheet and the components of the sheet ejecting device according to the third embodiment.
Figure 14:
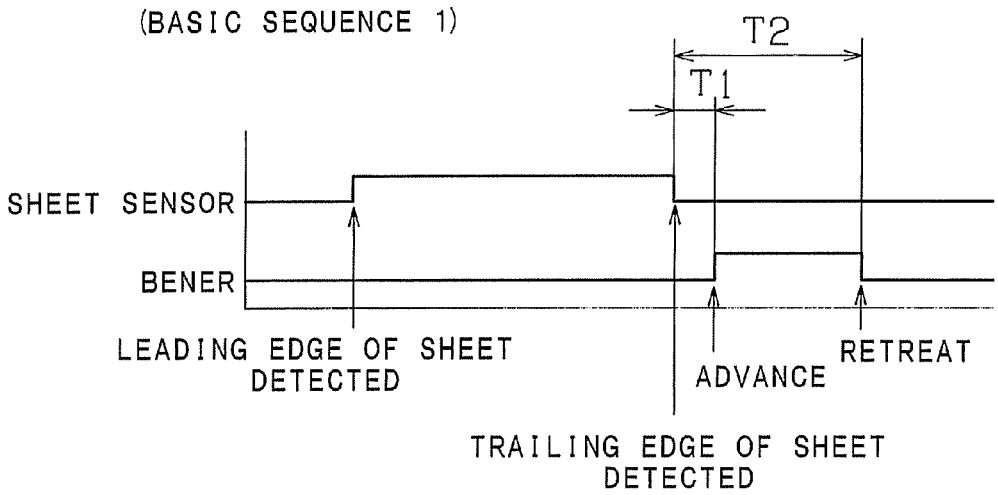
FIG. 14 is a time chart showing a first basic sequence for operating a bender in the sheet ejecting device according to the third embodiment.
Figure 15:
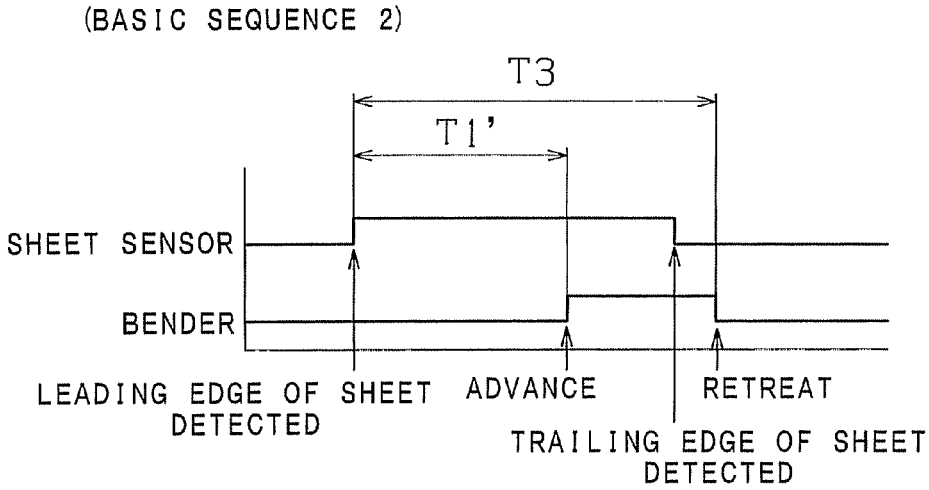
FIG. 15 is a time chart showing a second basic sequence for operating the bender in the sheet ejecting device according to the third embodiment.

See FIGS. 13-15

FIG. 13 shows the relationship between the position of the sheet S and the time to operate the bender 17 in the third embodiment. The reference symbol. "L1" denotes a predetermined distance (approximately 50 mm) by which the sheet S is further conveyed after the leading edge thereof comes into contact with the stack of sheets S'. The reference symbol "L2" denotes a distance (approximately 100 mm) between the nip portion of the ejection rollers 11 and the contact point of the leading edge of the sheet S with the stack of sheets S'. The reference symbol "L3" denotes a distance between the nip portion of the ejection rollers 11 and the trailing edge of the sheet S. The reference symbol, "L4" denotes a distance between the nip portion of the ejection rollers 11 and the sensor 19. The reference symbol "L3'" denotes a distance calculated by subtracting 30 mm from the distance L3. The distance L3 should be at least 30 mm, and operation of the bender 17 is started while the part L3' of the sheet S passes through the nip portion of the ejection rollers 11.

FIG. 14 shows a first basic sequence for operating the bender 17, and FIG. 15 shows a second basic sequence for operating the bender 17. In the first basic sequence shown by FIG. 14, a time T1 after the trailing edge of the sheet S is detected by the sensor 19, the bender 17 is moved to advance into the sheet ejection route. Then, a time T2 after the trailing edge of the sheet S is detected by the sensor 19, the bender 17 is moved to retreat from the sheet ejection route. Thus, in this case, the times to move the bender 17 to advance into and to retreat from the sheet ejection route are based on the detection signal of the trailing edge of the sheet S.

In the second base sequence shown by FIG. 15, a time T1' after the leading edge of the sheet S is detected by the sensor 19, the bender 17 is moved to advance into the sheet ejection route. Then, a time T3 after the leading edge of the sheet S is detected by the sensor 19, the bender 17 is moved to retreat from the sheet ejection route. The times to move the bender 17 (the times T1' and T3) depend on the size of the sheet S.

Setting of Bender Advancing Time

In the third embodiment, in the case in which the bender 17 is operated in accordance with the second base sequence shown by FIG. 15, the time T1' to move the bender 17 to advance into the sheet ejection route (to start canceling out the force provided for the sheet S by the strengthener 16) may be determined based on the size of the sheet S (the length of the sheet S in the sheet ejecting direction "A"), the kind of the sheet S, the environmental conditions, etc. Referring to FIG. 13, the distance of travel of the sheet S between the time when the sensor 19 detects the leading edge of the sheet S and the time when the bender 17 is moved to advance into the sheet ejection route shall be within a range from (L4+L2+L1) to (the length of the sheet S+L4−L3).

If the distance L4 is 60 mm and if the speed of conveying the sheet S is 300 mm/s, the time T1' shall be within a range as shown by Table 5 below.

TABLE 5

| | T1' |
|---|---|
| A4-Vertical | 0.7 sec.-1.09 sec. |
| A4-Lateral | 0.7 sec.-0.8 sec. |

When the sheet S is ejected via the ejection rollers 11, the sheet S bends downward by its own weight. The degree of the bend-down (the strength) of the sheet S depends on the kind of the sheet S (the weight per square meter, that is, whether to be thin paper, ordinary paper or thick paper, and whether to be recycled paper) and the environmental conditions (temperature and humidity). Therefore, it is preferred that the time T1' is determined based on the kind of the sheet S and the environmental conditions.

Table 6 below shows an exemplary setting of the time T1' in accordance with whether the sheet S is thin paper, ordinary paper or thick paper. Here, thin paper is paper with a weight per square meter smaller than 60 g/m$^2$. Ordinary paper is a paper with a weight per square meter within a range from 60 g/m$^2$ to 90 g/m$^2$. Thick paper is paper with a weight per square meter greater than 90 g/m$^2$.

TABLE 6

| | A4-Vertical | A4-Lateral |
|---|---|---|
| Thin Paper | 1.0 sec. | 0.8 sec. |
| Ordinary Paper | 0.9 sec. | 0.75 sec. |
| Thick Paper | 0.8 sec. | 0.7 sec. |

Further, recycled paper is relatively soft, and the time T1' in the case of ejecting a sheet of recycled paper may be set longer than the time T1' in the case of ejecting a sheet of non-recycled paper with the same weight per square meter. Table 8 shows an exemplary setting of the time T1' in accordance with whether the sheet S is recycled paper.

TABLE 7

| | A4-Vertical | A4-Lateral |
|---|---|---|
| Recycled Paper | 1.0 sec. | 0.8 sec. |
| Non-recycled Paper | 0.9 sec. | 0.75 sec. |

Furthermore, it is preferred that the time T1' is set longer as the temperature and the humidity become higher. Table 8 shows an exemplary setting of the time T1' in accordance with whether the sheet ejecting device is under high temperature and high humidity, under ordinary temperature and ordinary humidity, or low temperature and low humidity.

TABLE 8

| | A4-Vertical | A4-Lateral |
|---|---|---|
| High-Temp/High-Humid | 1.0 sec. | 0.8 sec. |
| Ordinary-Temp/Ordinary Humid | 0.9 sec. | 0.75 sec. |
| Low-Temp/Low-Humid | 0.8 sec. | 0.7 sec. |

Further, there may be a case in which the bender 17 is not operated depending on the size, the kind and the material of the sheet S and/or the environmental conditions.

Control Procedure

Figure 16:
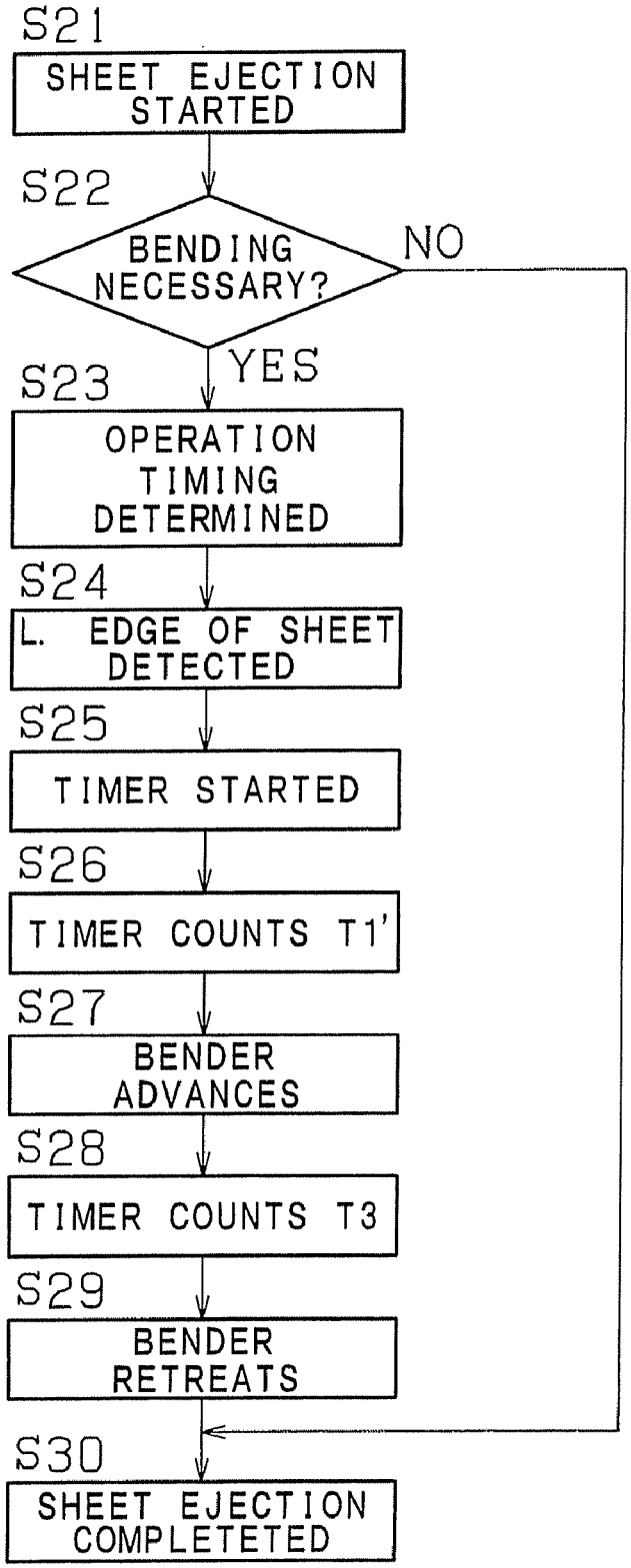
FIG. 16 is a flowchart showing a control procedure carried out in the sheet ejecting device according to the third embodiment.
Figure 17A:
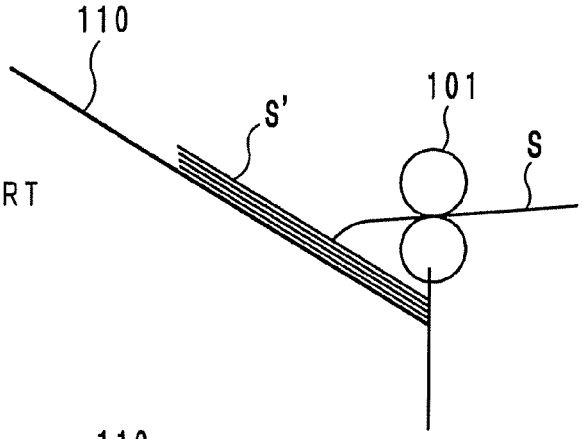
FIG. 17a PRIOR ART
FIGS. 17*a*-17*d* are illustrations of sheet ejection performed by a conventional sheet ejecting device.
Figure 17B:
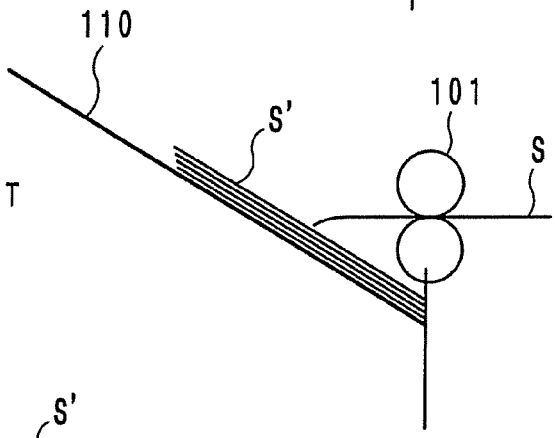
FIG. 17b PRIOR ART
Figure 17C:
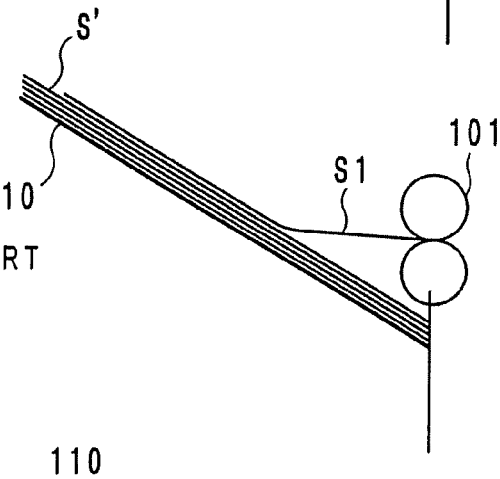
FIG. 17c PRIOR ART
Figure 17D:
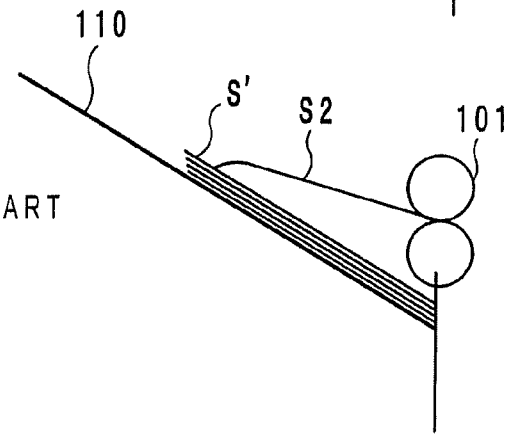
FIG. 17d PRIOR ART

See FIG. 16

Referring to FIG. 16, in the sheet ejecting device according to the third embodiment, a procedure for changing the time T1' in the second basic sequence in accordance with the conditions is described. Ejection of a sheet S is started (step S21). Then, after confirming that operation of the bender 17 is necessary ("YES" at step S22), the times T1' and T3 to move the bender 17 to advance into and to retreat from the sheet ejection route are determined based on the size and the kind of the sheet S and the environmental conditions (step S23). When the leading edge of the sheet S is detected by the sensor 19 (step S24), a timer is started (step S25). Then, the timer counts the time T1' (step S26), the bender 17 is moved to advance into the sheet ejection route (step S27) to cancel out the force provided for the sheet S by the strengthener 16. Further, when the timer counts the time T3 (step S28), the bender 17 is moved to retreat from the sheet ejection route (step S29). Then, ejection of the sheet S onto the tray 20 is completed (step S30).

Other Embodiments

The detailed constructions of the tray 20, the ejection rollers 11, the strengtheners 15, 16 and the bender 17 may be arbitrarily designed.

Although the present invention has been described in connection with the preferred embodiments above, various changes and modifications are possible to those who are skilled in the art. Such changes and modifications are to be understood as being within the scope of the present invention.

What is claimed is:

1. A sheet ejecting device for ejecting printed sheets along a sheet ejection route to a stacker one by one, said sheet ejecting device comprising:

a pair of ejection rollers for ejecting a sheet;

a strengthener, arranged above the sheet ejection route, and arranged to be capable of advancing into and retreating from the sheet ejection route, for strengthening a sheet;

a driver for moving the strengthener to advance into and retreat from the sheet ejection route;

a sensor for detecting a currently ejected sheet; and a controller for controlling the driver based on a signal sent from the sensor;

wherein the controller controls the driver so that the strengthener advances into the sheet ejection route from above the sheet ejection route and so that the strengthener retreats from the sheet ejection route to a location above the sheet ejection route at a time after a leading edge of the currently ejected sheet comes into contact with a stack of sheets on the stacker and before a trailing edge of the sheet passes the pair of ejection rollers.

2. A sheet ejecting device according to claim 1, wherein the controller determines at least one of a time to move the strengthener to advance into the sheet ejection route and a time to move the strengthener to retreat from the sheet ejection route based on a size of the currently ejected sheet.

3. A sheet ejecting device according to claim 1, wherein the controller determines at least one of a time to move the strengthener to advance into the sheet ejection route and a time to move the strengthener to retreat from the sheet ejection route based on a kind of the currently ejected sheet.

4. A sheet ejecting device according to claim 3, wherein the kind of the sheet to be ejected means whether the sheet is at least one of thin paper, ordinary paper, thick paper and recycled paper.

5. A sheet ejecting device according to claim 1, wherein the controller determines at least one of a time to move the strengthener to advance into the sheet ejection route and a time to move the strengthener to retreat from the sheet ejection route based on an environmental condition.

6. A sheet ejecting device according to claim 5, wherein the environmental condition is based on temperature and humidity.

7. A sheet ejecting device according to claim 1, wherein the strengthener comprises a plurality of components, at least one of the components being capable of advancing into and retreating from the sheet ejection route independently of the other components.

8. A sheet ejecting device according to claim 7, wherein the plurality of components are selectively moved to advance into and retreat from the sheet ejection route.

9. A sheet ejecting device according to claim 1, wherein the strengthener is advanced into and retreated from the sheet ejection route by pivoting about a point at one end of the strengthener.

10. A sheet ejecting device according to claim 1, wherein the strengthener is L-shaped.

* * * * *